US007937811B2

(12) United States Patent
Saeger et al.

(10) Patent No.: US 7,937,811 B2
(45) Date of Patent: May 10, 2011

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventors: Nicole Saeger, Aachen (DE); Johannes Bossmann, Mönchengladbach (DE); Thomas Schmitz, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 383 days.

(21) Appl. No.: 12/163,032

(22) Filed: Jun. 27, 2008

(65) Prior Publication Data

US 2009/0000066 A1 Jan. 1, 2009

(30) Foreign Application Priority Data

Jun. 29, 2007 (DE) ..... 10 2007 030 471
Jun. 29, 2007 (DE) ..... 20 2007 010 686 U
Nov. 9, 2007 (DE) ..... 10 2007 053 894

(51) Int. Cl.
*D01G 19/00* (2006.01)

(52) U.S. Cl. ..... 19/217

(58) Field of Classification Search ..... 19/115 R, 19/128, 215, 216, 217
See application file for complete search history.

(56) References Cited

U.S. PATENT DOCUMENTS 1,408,780 A * 3/1922 Schleifer ..... 19/217
1,425,059 A * 8/1922 Schleifer ..... 19/217
1,694,432 A * 12/1928 Schleifer ..... 19/217
1,708,032 A * 4/1929 Schleifer ..... 19/217
1,715,473 A * 6/1929 Schleifer ..... 19/217
1,799,066 A * 3/1931 Schleifer ..... 19/217
2,044,460 A * 6/1936 Bartram et al. ..... 19/99
2,962,772 A 12/1960 Draving et al.
3,108,333 A * 10/1963 Schleifer ..... 19/235
4,270,245 A 6/1981 Stewart et al.
5,007,623 A 4/1991 Unkuri et al.
5,343,686 A * 9/1994 Buchner et al. ..... 57/263
(Continued)

FOREIGN PATENT DOCUMENTS

DE 367482 C 1/1923
(Continued)

OTHER PUBLICATIONS

German Patent Office Search Report, dated Aug. 8, 2007, issued in related German Application No. 10 2006 050 384.8, and English language translation of Section C.

(Continued)

*Primary Examiner* — Shaun R Hurley
(74) *Attorney, Agent, or Firm* — Venable LLP; Robert Kinberg; Steven J. Schwarz

(57) ABSTRACT

In an apparatus for the fibre-sorting or fibre-selection of fibre material which is supplied by means of a supply device to a fibre-sorting device, mechanical means are present which generate a combing action to remove non-clamped constituents such as short fibres. Downstream of the supply device there are arranged at least two rotatably mounted rollers with clamping devices for the fibre bundles, and the supply device comprises a feed unit, which feed unit comprises a feed roller and at least one feed tray defining a nip between said feed roller and said feed tray, and the retaining force in the nip optimally retains the short fibres completely or substantially completely in the nip during separation of a fibre bundle by said clamping devices.

24 Claims, 13 Drawing Sheets

U.S. PATENT DOCUMENTS

| | | | | |
|---|---|---|---|---|
| 5,404,619 | A | 4/1995 | Jorg | |
| 5,457,851 | A | 10/1995 | Mondini | |
| 5,502,875 | A | 4/1996 | Stolz et al. | |
| 5,796,220 | A | 8/1998 | Clapp et al. | |
| 6,163,931 | A * | 12/2000 | Leifeld | 19/105 |
| 6,173,478 | B1 | 1/2001 | Patelli et al. | |
| 6,216,318 | B1 * | 4/2001 | Leifeld | 19/105 |
| 6,235,999 | B1 * | 5/2001 | Rubenach | 177/116 |
| 6,295,699 | B1 | 10/2001 | Temburg | |
| 6,499,194 | B1 | 12/2002 | Gresser et al. | |
| 6,611,994 | B2 | 9/2003 | Bischofberger et al. | |
| 7,173,207 | B2 | 2/2007 | Losbrock et al. | |
| 2002/0124354 | A1 * | 9/2002 | Pferdmenges et al. | 19/105 |
| 2003/0005551 | A1 | 1/2003 | Schurenkramer et al. | |
| 2003/0029003 | A1 | 2/2003 | Breuer et al. | |
| 2003/0070260 | A1 * | 4/2003 | Rubenach | 19/105 |
| 2003/0154572 | A1 | 8/2003 | Pferdmenges et al. | |
| 2004/0040121 | A1 | 3/2004 | Schmitz | |
| 2004/0128799 | A1 | 7/2004 | Hosel et al. | |
| 2005/0076476 | A1 | 4/2005 | Temburg | |
| 2005/0198783 | A1 * | 9/2005 | Rubenach | 19/105 |
| 2005/0278900 | A1 | 12/2005 | Dammig | |
| 2006/0260100 | A1 * | 11/2006 | Duda et al. | 19/236 |
| 2007/0180658 | A1 | 8/2007 | Saeger et al. | |
| 2007/0180659 | A1 | 8/2007 | Saeger et al. | |
| 2007/0180660 | A1 | 8/2007 | Saeger et al. | |
| 2007/0266528 | A1 | 11/2007 | Farber et al. | |
| 2008/0092339 | A1 | 4/2008 | Bossman et al. | |
| 2009/0000064 | A1 | 1/2009 | Saeger et al. | |
| 2009/0000065 | A1 | 1/2009 | Saeger et al. | |
| 2009/0000067 | A1 * | 1/2009 | Leder et al. | 19/115 R |
| 2009/0000068 | A1 * | 1/2009 | Saeger et al. | 19/115 R |
| 2009/0000069 | A1 | 1/2009 | Saeger et al. | |
| 2009/0000070 | A1 | 1/2009 | Saeger et al. | |
| 2009/0000071 | A1 | 1/2009 | Saeger et al. | |
| 2009/0000072 | A1 | 1/2009 | Saeger et al. | |
| 2009/0000073 | A1 | 1/2009 | Saeger et al. | |
| 2009/0000074 | A1 | 1/2009 | Bossmann | |
| 2009/0000075 | A1 | 1/2009 | Saeger et al. | |
| 2009/0000076 | A1 | 1/2009 | Bossmann et al. | |
| 2009/0000077 | A1 | 1/2009 | Saeger et al. | |
| 2009/0000078 | A1 | 1/2009 | Saeger et al. | |
| 2009/0000079 | A1 | 1/2009 | Bossmann | |

FOREIGN PATENT DOCUMENTS

| | | | |
|---|---|---|---|
| DE | 382169 | C | 9/1923 |
| DE | 399885 | C | 7/1924 |
| DE | 489 420 | C | 1/1930 |
| DE | 30 48 501 | A1 | 7/1982 |
| DE | 103 20 452 | A1 | 11/2004 |
| EP | 1 586 682 | A1 | 10/2005 |
| WO | WO-2006/012758 | A1 | 2/2006 |

OTHER PUBLICATIONS

German Patent Office Search Report, dated Jul. 10, 2007, Issued in DE 10 2006 050 453.4, and partial English-language translation.

U.S. Office Action dated Feb. 26, 2010, issued in related U.S. Appl. No. 12/149,506.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATIONS

This application claims priority from German Utility Model Application No. 20 2007 010 686.6 dated Jun. 29, 2007, and German Patent Application No. 10 2007 053 894.6 dated Nov. 9, 2007, the disclosure of each of which is incorporated herein by reference.

BACKGROUND OF THE INVENTION

The invention relates to an apparatus for the fibre-sorting or fibre-selection of a fibre bundle comprising textile fibres, especially for combing. In certain known apparatus, fibre sliver is supplied by means of a supply device to a fibre-sorting device, especially to a combing device, in which clamping devices are provided, which clamp the fibre bundle at a distance from its free end and mechanical means are present which generate a combing action from the clamping site to the free end of the fibre bundle in order to loosen and remove non-clamped constituents, such as, for example, short fibres, neps, dust and the like from the free end.

In practice, combing machines are used to free cotton fibres or woollen fibres of natural impurities contained therein and to parallelise the fibres of the bundle sliver. For that purpose, a previously prepared fibre sliver is clamped between the jaws of the nipper arrangement so that a certain sub-length of the fibres, known as the "fibre tuft" projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre tuft and carry it onwards. The known cotton-combing process is a discontinuous process. During a nipping operation, all assemblies and their drive means and gears are accelerated, decelerated and in some cases reversed again.

High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre bundle supplied by the nipper assembly, a top comb and a fixed-position detaching device for detaching the combed-out fibre bundle from the nipper assembly. The lap ribbon supplied to the nipper assembly is here fed via a feed cylinder to a detaching roller pair. The fibre bundle protruding from the opened nipper passes onto the rearward end of a combed sliver web or fibre web, whereby it enters the clamping nip of the detaching rollers owing to the forward movement of the detaching rollers. The fibres that are not retained by the retaining force of the lap ribbon, or by the nipper, are detached from the composite of the lap ribbon. During this detaching operation, the fibre bundle is additionally pulled by the needles of a top comb. The top comb combs out the rear part of the detached fibre bundle and also holds back neps, impurities and the like. The top comb, for which in structural terms space is required between the movable nipper assembly and the movable detaching roller, has to be constantly cleaned by having air blown through it. For piercing into and removal from the fibre sliver, the top comb has to be driven. Finally, the cleaning effect at this site of jerky movement is not ideal. Owing to the differences in speed between the lap ribbon and the detaching speed of the detaching rollers, the detached fibre bundle is drawn out to a specific length. Following the detaching roller pair is a guide roller pair. During this detaching operation, the leading end of the detached or pulled off fibre bundle is overlapped or doubled with the trailing end of the fibre web. As soon as the detaching operation and the piecing operation have ended, the nipper returns to a rear position in which it is closed and presents the fibre bundle protruding from the nipper to a comb segment of a circular comb for combing out. Before the nipper assembly now returns to its front position again, the detaching rollers and the guide rollers perform a reversing movement, whereby the trailing end of the fibre web is moved backwards by a specific amount. This is required to achieve a necessary overlap for the piecing operation. In this way, a mechanical combing of the fibre material is effected. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the ecartement, that is to say the distance between the nipper lip of the lower nipper plate and the clamping point of the detaching cylinder, is structurally and spatially limited. The rotational speed of the detaching rollers and the guide rollers, which convey the fibre bundles away, is matched to the upstream slow combing process and is limited by this. A further drawback is that each fibre bundle is clamped and conveyed by the detaching roller pair and subsequently by the guide roller pair. The clamping point changes constantly owing to the rotation of the detaching rollers and the guide rollers, i.e. there is a constant relative movement between the rollers effecting clamping and the fibre bundle. All fibre bundles have to pass through the one fixed-position detaching roller pair and the one fixed-position guide roller pair in succession, which represents a further considerable limitation of the production speed.

SUMMARY OF THE INVENTION

It is an aim of the invention to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres having:

a fibre sorting device in which clamping devices are provided which each clamp a bundle of the textile fibres at a distance from its free end;

a supply device for supplying the fibre bundle to the fibre-sorting device; and at least one mechanical device for generating a combing action from the clamping site to the free end of the fibre bundle in order to loosen and remove non-clamped constituents;

wherein the fibre-sorting device comprises at least first and second rotatably mounted rollers that, in use, rotate rapidly without interruption, the clamping devices being distributed spaced apart in the region of the periphery of at least one said roller, and wherein the supply device comprises a feed unit, which feed unit comprises a feed roller and at least one feed tray defining a nip therebetween, the retaining force in the nip being such that the short fibres are completely or substantially completely retained in the nip during separation of the fibre bundle by at least one said clamping device associated with said first roller.

By implementing the functions of clamping and moving the fibre bundles to be combed-out on rotating rollers, preferably a turning rotor and a combing rotor, high operating speeds (nip rates) are achievable—unlike the known apparatus—without large mass accelerations and reversing movements. In particular, the mode of operation is continuous. When high-speed rollers are used, a very substantial increase in hourly production rate (productivity) is achievable which had previously not been considered possible in technical circles. A further advantage is that the rotary rotational movement of the rollers with the plurality of clamping devices leads to an unusually rapid supply of a plurality of fibre bundles per unit of time to the first roller and to the second roller. In particular the high rotational speed of the rollers allows production to be substantially increased. The fibre bundles are—unlike the known apparatus—held by a plurality of clamping devices and transported under rotation. The clamping point at the particular clamping devices therefore remains substantially constant on each roller until the fibre bundles are transferred to the subsequent roller or take-off roller. A relative movement between clamping device and fibre bundle does not begin until after the fibre bundle has been gripped by the first or a subsequent roller, and in addition clamping has been terminated. Because a plurality of clamping devices is available for the fibre bundles, in an especially advantageous manner fibre bundles can be supplied to the first and second roller respectively one after the other and in quick succession, without undesirable time delays resulting from just a single supply device. A particular advantage is that the supplied fibre bundles on the first roller (that is, preferably, the turning rotor) are continuously transported. The speed of the fibre bundle and of the co-operating clamping elements is the same. The clamping elements close and open during the movement in the direction of the transported fibre material. The second roller (that is, preferably, the combing rotor) is arranged downstream of the first roller (that is, preferably, the turning rotor). With the apparatus according to the invention, an optimum ratio between adequate retaining force of the fibre material fed or to be fed in and lowest possible separation force during separation of the feed tuft from the supplied fibre mass is achieved.

To form the fibre bundle, the fibre sliver pushed forward by the feed roller is clamped at one end by a clamping device, and is detached by the rotary movement of the turning rotor. The clamped end contains short fibres, the free region comprises the long fibres. The long fibres are pulled by separation force out of the fibre material clamped in the feed nip, short fibres remaining behind through the retaining force in the feed nip. In this way, an optimum ratio between adequate retaining force of the fibre material feed and lowest possible separation force during separation of the feed tuft from the supplied fibre mass is advantageously implemented. Subsequently, as the fibre bundle is delivered from the turning rotor onto the combing rotor the ends of the fibre bundle are reversed: the clamping device on the combing rotor grips and clamps the end with the long fibres, so that the region with the short fibres projects from the clamping device and lies exposed and can thereby be combed out.

In certain preferred embodiments, the feed unit comprises a top tray or a bottom tray and a feed roller. In some embodiments, the feed unit may be arranged in a fixed position at the periphery of the turning rotor. In other embodiments, the position of the feed roller and the turning rotor with respect to one another may be adjustable. In some embodiments the position of the centre points of the feed roller and the turning rotor with respect to one another may be adjustable. Advantageously, the position of the clamping line or the clamping region of the tray is adjustable over the periphery of the feed roller. Advantageously, the feed amount is flexibly and infinitely adjustable. Advantageously, the tray geometry is variably configured, for example, with different nip geometries. Advantageously, the length of the tray and the tray contour are alterable. With a constant tray geometry, different nip geometries are advantageously present through variable tray settings. Advantageously, the nip geometry may be adapted to the material to achieve an optimum, in respect of the retaining force set and the separation force required to release the feed bundle from the material feed. Advantageously, the tray is loadable with variable forces. Advantageously, the tray is a divided tray. In some embodiments, the tray element is in the form of a plurality of segments, in particular more than two segments. Advantageously, the inner surface of the tray is as smooth as possible, for example, polished or Teflon-coated. Advantageously, the surface of the feed roller is of textured construction, e.g. milled rollers (criss-cross milling etc.), square-cut clothings or all-steel clothings having different clothing geometries. In some embodiments, a jetting from the roller is effected to achieve an optimised feed bundle deflection and feed bundle separation. Advantageously, the jetting pressure and the jetting angle are adjustable. To assist the retaining force in the tray region or to generate the retaining force, the feed roller is advantageously provided with a reduced pressure region. Advantageously, the reduced pressure is adjustable. Advantageously, the suction can be effected continuously or in timed mode. When jetting from the feed roller or when implementing a reduced pressure region in the feed roller, the feed roller is advantageously perforated. When clothed rollers are used, in order to be air permeable, clothings with a profiled clothing foot are advantageously present. Advantageously, a portion of the inner cylindrical surface of the feed roller is sealed by screen elements. Advantageously, the spacing of the screen elements from the feed roller in the radial direction is as small as possible. In some embodiments, slide ring seals are used, so that distances of 0 mm are present.

In some embodiments, laps are feedable to the feed unit. In other embodiments, slivers are feedable to the feed unit. Advantageously, the infeed weight amounts to about 60 to 80 ktex. Advantageously, during lap feed an automatic lap change with an automatic piecing process is effected. Advantageously, lap transport from the lap-forming machine to the rotor combing machine is effected by means of conveyor systems. Advantageously, the material infeed is effected continuously. The feed may be effected according to predetermined equations of motion. Advantageously, at first an initially rapid feed is effected, which becomes slower towards the end of the feed. Advantageously, the feed is effected in the form of a pilgrim-step motion. Advantageously, elements for the sliver or lap feed are present. In the case of a sliver feed, a driven supply table may be present, for example. In the case of a lap feed, drive rollers and guide plates may be present, for example. Advantageously, immediately upstream of the inlet to the feed tray a pre-compression of the incoming fibre material is effected, for example, by leaf springs, loaded rollers or funnels.

Advantageously, additional elements are arranged in the turning rotor for the accelerated feed bundle deflection and separation, for example, a region with air passage openings, which is connected to a source of reduced pressure. Advantageously, the reduced pressure is adjustable. Advantageously, suction is effected continuously. Advantageously, suction is effected in timed mode. In some embodiments, the region with the air passage openings is advantageously arranged inside the periphery of the turning rotor.

Advantageously, an optimised feed bundle deflection and separation can be effected by an externally mounted nozzle assembly. Advantageously, the jetting pressure and the jetting angle and the position of the nozzles are adjustable. Advantageously, a top comb is arranged between feed device and turning rotor. Advantageously, means for measuring lap thickness are integrated in the tray. Advantageously, elements for determining the tray clamping force (linear or area load) are integrated in the tray. Advantageously, more than one feed device is present, for example, two feed devices, from which material is transferred to a turning rotor. Advantageously, at least one pressure-applying element is associated with the feed roller for pre-compression. Advantageously, the pressure-applying element is a roller. In some embodiments, the drive of the roller is effected by means of a positive drive on the feed roller. In other embodiments, the roller has its own drive. By virtue of a recess in the tray element, the clamping region of the roller, for example the clamping line, is advantageously situated as close as possible to the trough inlet. Advantageously, the surface of the roller is rubberised. Advantageously, the roller is a solid roller. Advantageously, the roller is a milled roller. Advantageously, the roller is clothed. Advantageously, the load force of the roller is adjustable. Advantageously, the roller is biased, for example, it is spring loaded.

Advantageously, the at least two rotatably mounted rollers that rotate rapidly without interruption comprise at least one turning rotor and at least one combing rotor. Advantageously, the turning rotor and the combing rotor have opposite directions of rotation. Advantageously, for suction of the supplied fibre bundles, at least one suction device is associated with the clamping devices in the region of the transfer of the fibre bundle from the supply device to the first roller and/or in the region of the transfer of the fibre material from the first roller to the second roller.

The invention also provides an apparatus for the fibre-sorting or fibre-selection of a fibre bundle comprising textile fibres, especially for combing, which is supplied by means of a supply device to a fibre-sorting device, especially a combing device, in which clamping devices are provided which clamp the fibre bundle at a distance from its free end, and mechanical means are present which generate a combing action from the clamping site to the free end of the fibre bundle, in order to loosen and remove non-clamped constituents, such as, for example, short fibres, neps, dust and the like from the free end, characterised in that that downstream of the supply device there are arranged at least two rotatably mounted rollers rotating rapidly without interruption which are provided with clamping devices for the fibre bundle, which clamping devices are distributed spaced apart in the region of the periphery of at least one said roller, the supply device comprises a feed roller and at least one feed tray, with a nip in between and the retaining force in the nip optimally retains the short fibres completely or virtually completely in the nip during separation of the fibre bundle by clamping devices.

DETAILED DESCRIPTION OF CERTAIN PREFERRED EMBODIMENTS

Figure 1:
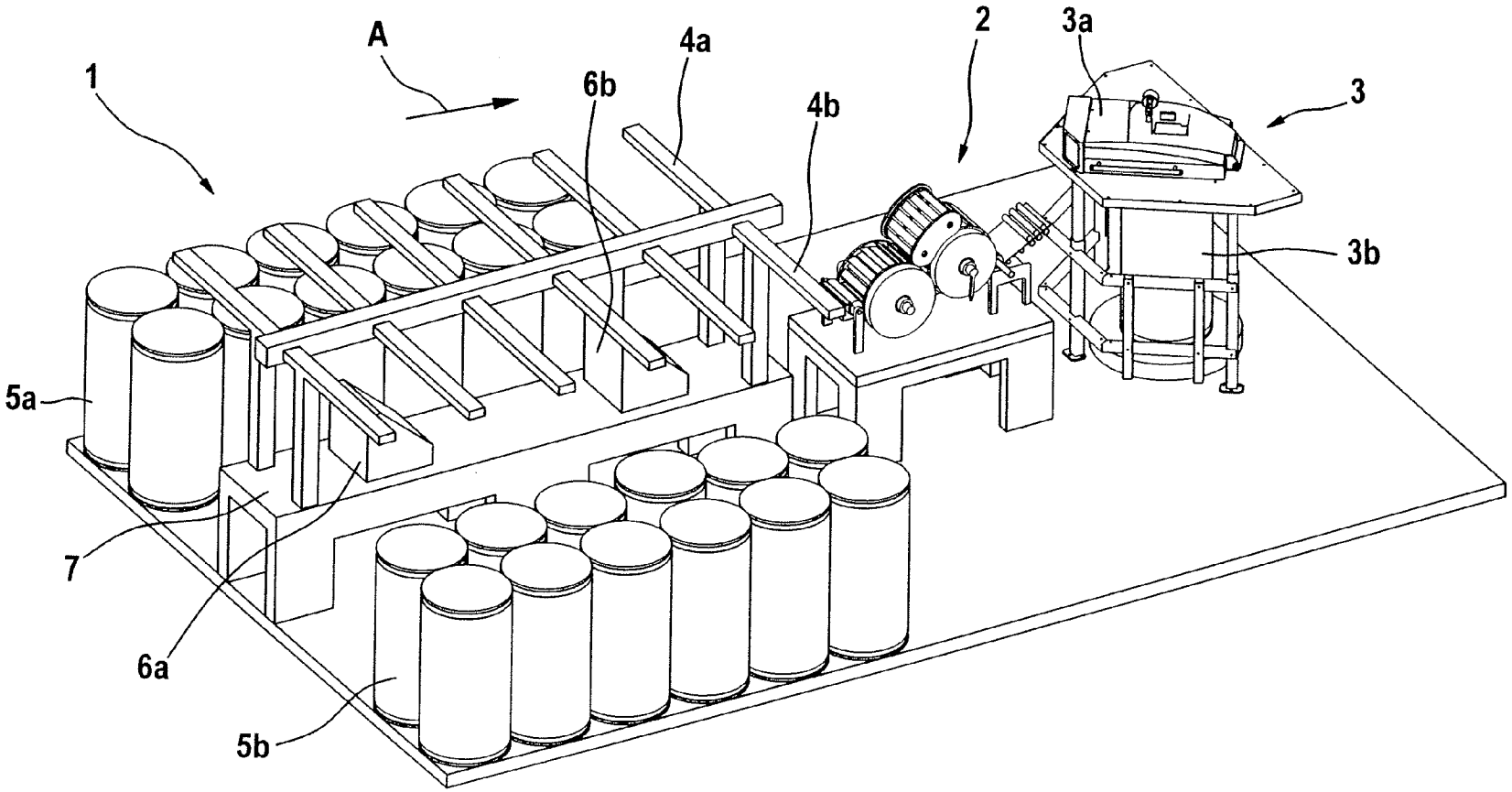
FIG. 1 is a diagrammatic perspective view of a device for combing fibre material, comprising a combing preparation device, a rotor combing machine and a sliver-deposition device.

With reference to FIG. 1, a combing preparation machine 1 has a sliver-fed and lap-delivering spinning room machine and two feed tables 4*a*, 4*b* (creels) arranged parallel to one another, there being arranged below each of the feed tables 4*a*, 4*b* two rows of cans 5*a*, 5*b* containing fibre slivers (not shown). The fibre slivers withdrawn from the cans 5*a*, 5*b* pass, after a change of direction, into two drafting systems 6*a*, 6*b* of the combing preparation machine 1, which are arranged one after the other. From the drafting system 6*a*, the fibre sliver web that has been formed is guided over the web table 7 and, at the outlet of the drafting system 6*b*, laid one over the other and brought together with the fibre sliver web produced therein. By means of the drafting systems 6*a* and 6*b*, in each case a plurality of fibre slivers are combined to form a lap and drafted together. A plurality of drafted laps (two laps in the example shown) are doubled by being placed one on top of the other. The lap so formed is introduced directly into the supply device (feed element) of the downstream rotor combing machine 2. The flow of fibre material is not interrupted. The combed fibre web is delivered at the outlet of the rotor combing machine 2, passes through a funnel, forming a comber sliver, and is deposited in a downstream sliver-deposition device 3. Reference numeral A denotes the operating direction.

An autoleveller drafting system 50 (see FIG. 2) can be arranged between the rotor combing machine 2 and the sliver-deposition device 3. The comber sliver is thereby drafted.

In accordance with a further embodiment, more than one rotor combing machine 2 is provided. If, for example, two rotor combing machines 2*a* and 2*b* are present, then the two delivered comber slivers 17 can pass together through the downstream autoleveller drafting system 50 and be deposited as one drafted comber sliver in the sliver-deposition device 3.

The sliver-deposition device 3 comprises a rotating coiler head 3*a*, by which the comber sliver can be deposited in a can 3*b* or (not shown) in the form of a can-less fibre sliver package.

Figure 2:
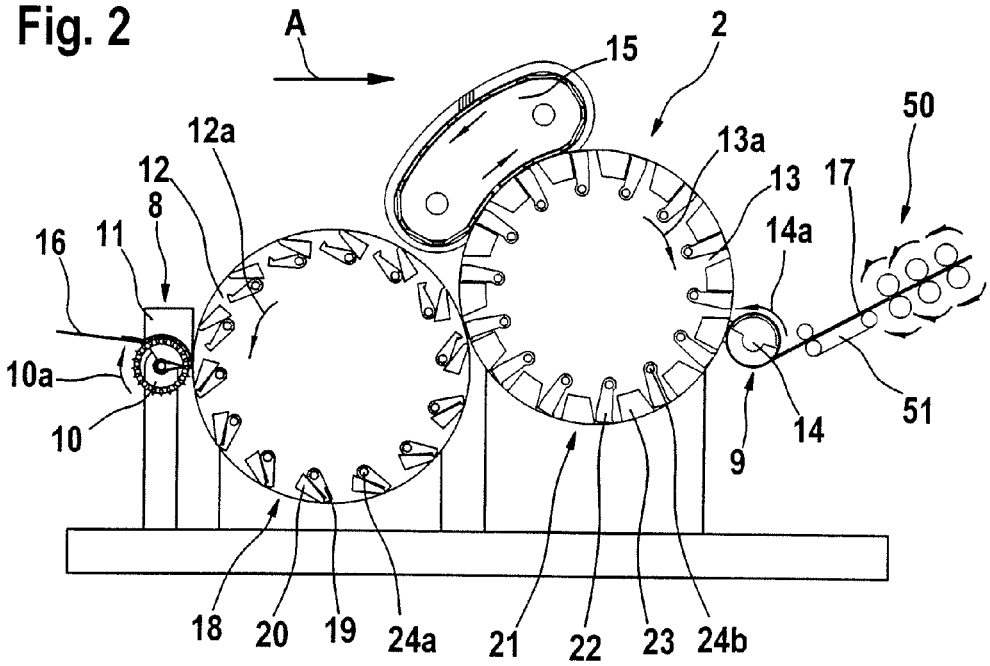
FIG. 2 is a diagrammatic side view of a rotor combing machine according to the invention having two rollers.

FIG. 2 shows a rotor combing machine 2 having a supply device 8 comprising a feed roller 10 and a feed tray 11, having a first roller 12 (turning rotor), second roller 13 (combing rotor), a take-off device 9 comprising a take-off roller 14 and a revolving card top combing assembly 15. The directions of rotation of the rollers 10, 12, 13 and 14 are shown by curved arrows 10*a*, 12*a*, 13*a* and 14*a*, respectively. The incoming fibre lap is indicated by reference numeral 16 and the delivered fibre web is indicated by reference numeral 17. The rollers 10, 12, 13 and 14 are arranged one after the other. Arrow A denotes the operating direction.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a*, which is attached to the roller 12. The lower nipper 20 is mounted on the roller 12 so as to be either fixed or movable. The free end of the upper nipper 19 faces the periphery of the roller 12. The upper nipper 19 and the lower nipper 20 co-operate so that they are able to grip a fibre bundle 16, $\mathbf{30}_1$, $\mathbf{30}_2$ (clamping) and release it.

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b*, which is attached to the roller 13. The lower nipper 23 is mounted on the roller 13 so as to be either fixed (see FIG. 9) or movable. The free end of the upper nipper 22 faces the periphery of the roller 13. The upper nipper 22 and the lower nipper 23 co-operate so that they are able to grip a fibre bundle $\mathbf{30}_2$ (clamping) and release it. In the case of roller 12, around the roller periphery between the feed roller 10 and the second roller 13 the clamping devices 18 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the doffer 14 and the first roller 12 the clamping devices 21 are open. Reference numeral 50 denotes a drafting system, for example an autoleveller drafting system. The drafting system 50 is advantageously arranged above the coiler head 3*a*. Reference numeral 51 denotes a driven ascending conveyor, for example a conveyor belt. It is also possible to use an upwardly inclined metal sheet or the like for conveying purposes.

Figure 3:
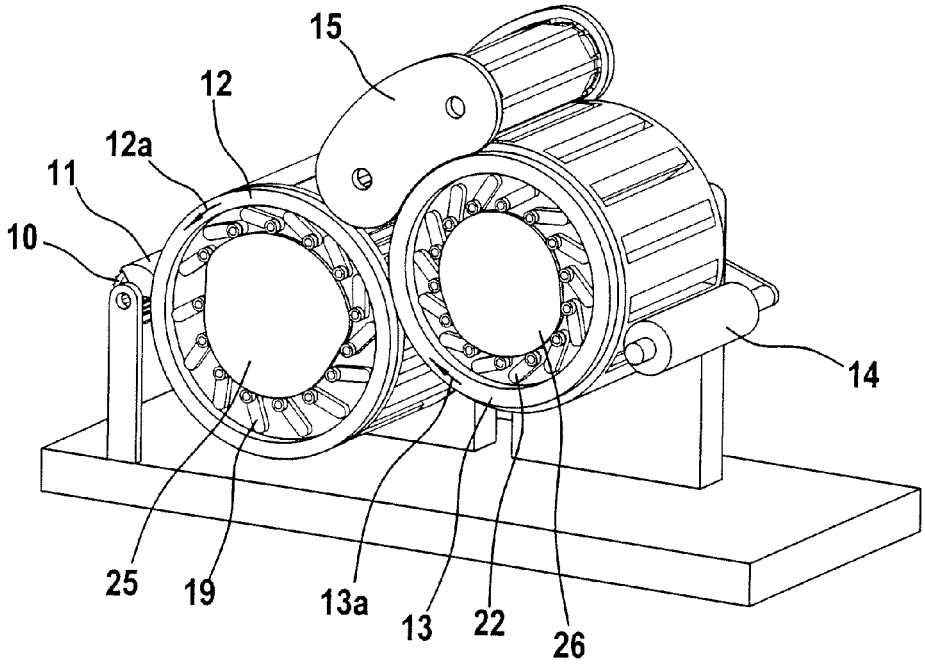
FIG. 3 is a perspective view of a rotor combing machine constructed substantially as shown in FIG. 2 and further having two cam discs.

In the embodiment of FIG. 3, two fixed cam discs 25 and 26 are provided, about which the roller 12 having the first clamping devices 18 and the roller 13 having the second clamping devices 21 are rotated in the direction of arrows 12*a* and 13*a*, respectively. The loaded upper nippers 19 and 22 are arranged in the intermediate space between the outer periphery of the cam discs 25, 26 and the inner cylindrical surfaces of the rollers 12, 13. By rotation of the rollers 12 and 13 about the cam discs 25 and 26, the upper nippers 19 and 22 are rotated about pivot axes 24*a* and 24*b*, respectively. In that way, the opening and closing of the first clamping devices 18 and the second clamping devices 21 is implemented.

Figure 4:
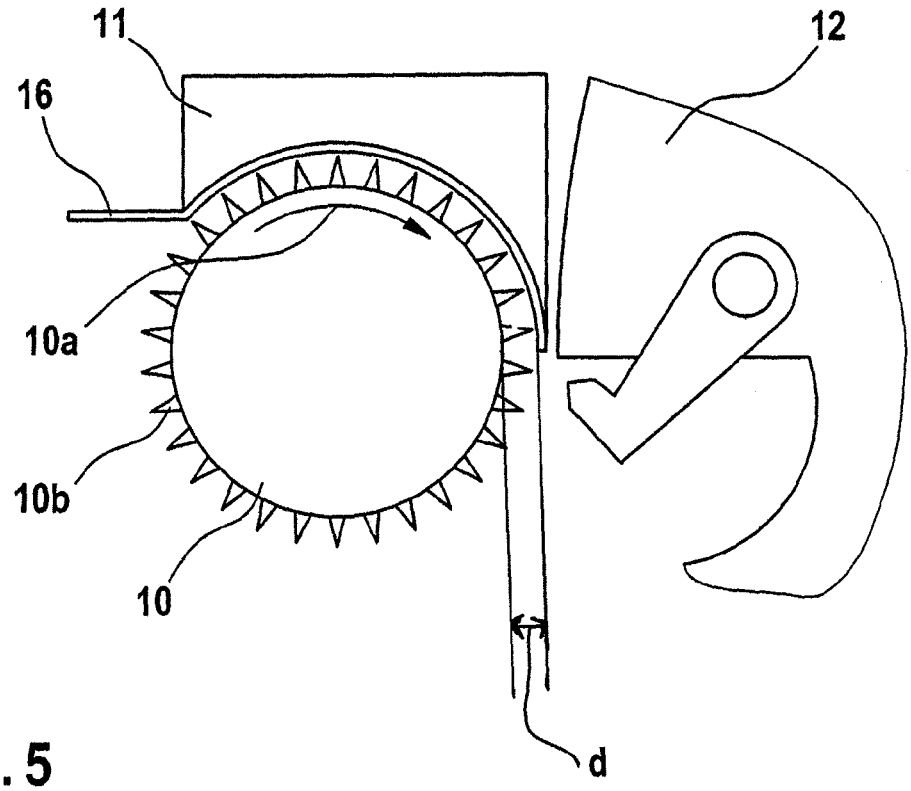
FIG. 4 shows a top comb roller as supply means, and an upper feed tray.
Figure 5:
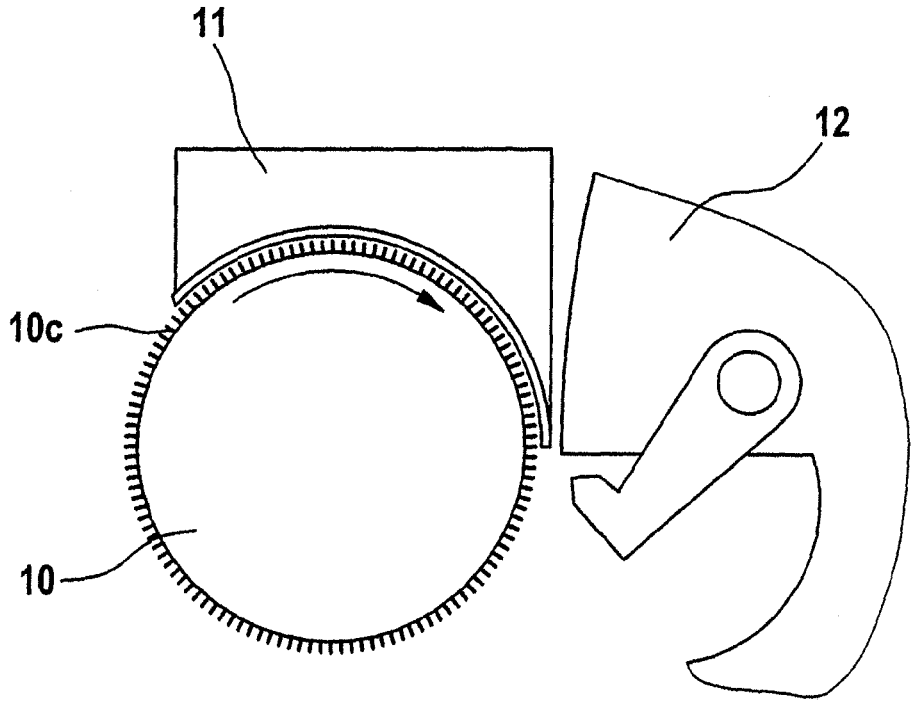
FIG. 5 shows a clothed roller as supply means.
Figure 6:
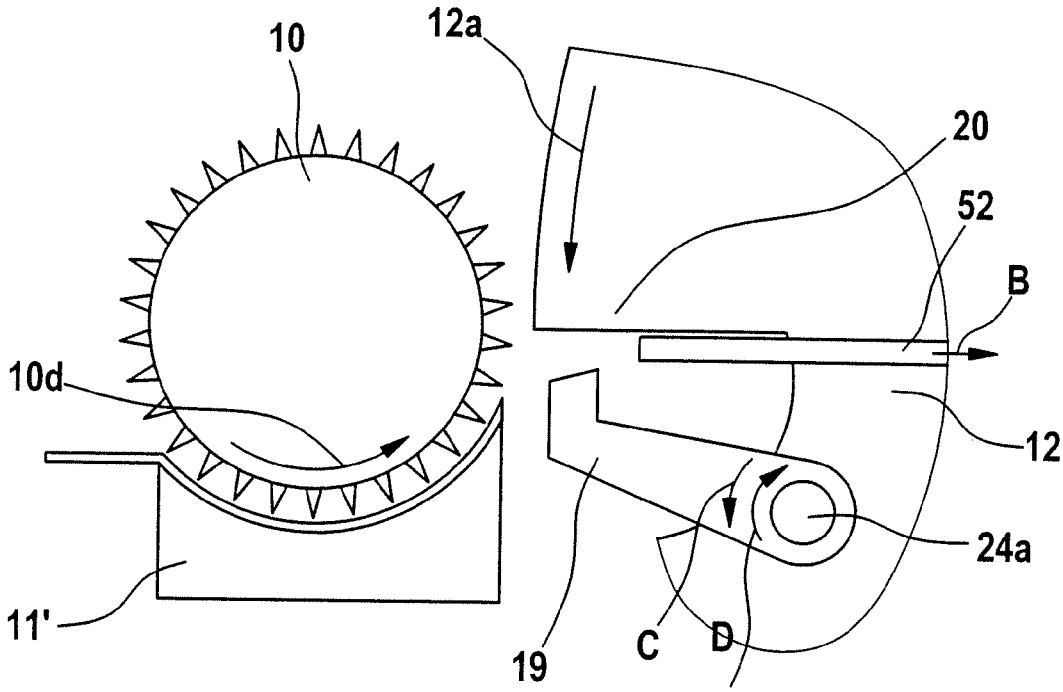
FIG. 6 shows a feed roller with bottom feed tray.
Figure 7:
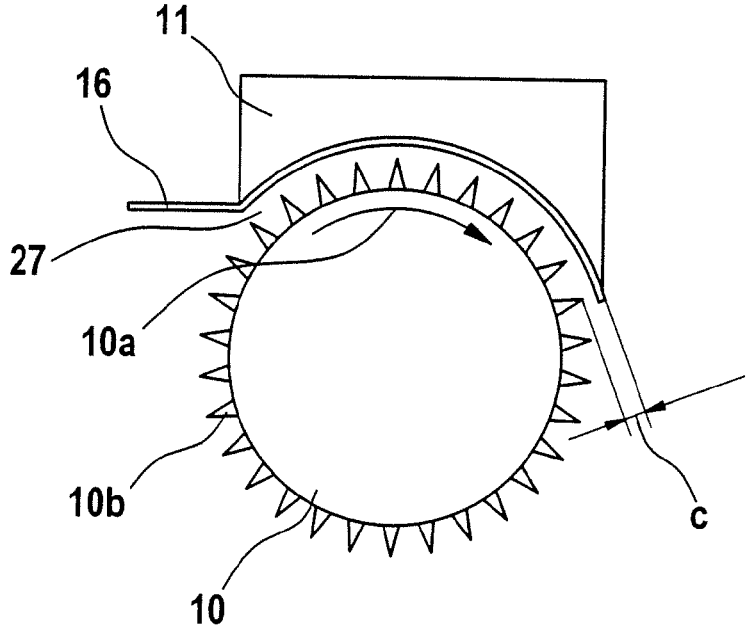
FIG. 7 shows the clamping nip between feed roller and feed tray.

In the embodiment of FIG. 4, the feed roller 10 has around its periphery comb segments 10*b*, which are arranged axially parallel across the width. The fibre material 16 is located in the clamping nip 27 (see FIG. 7) between feed roller 10 and feed tray 11 (top tray). The feed roller 10 rotates clockwise corresponding to arrow 10*a*. The feed roller 10 in accordance with FIG. 5 has a clothing 10*c* around its periphery, preferably an all-steel clothing. In the embodiment shown in FIG. 6, a feed tray 111 (bottom tray) is arranged beneath the feed roller 10. The feed roller 10 rotates anticlockwise in the direction of the arrow 10*d*. The clamping nip between the slowly rotating feed roller 10 and the fixed-position feed tray 11 is denoted by the reference numeral 27, as shown in FIG. 7. The fibre material 16 is slowly pushed forwards in the clamping nip 27 by the pins 10*b* rotating in the direction of rotation 10*a*. The distance between the tips of the pins 10*b* and the concavely curved inner surface of the feed trough 11 is denoted by the letter c. The distance between the cylindrical surface of the feed roller 10 and the inner surface of the feed tray 11 is denoted by the letter d. The retaining force in the nip 27 is definitively determined by the holding action of the elements (e.g. pins 10*b*, clothing 10*c* and the like) on the feed roller 10 and the clamping effect in the nip 27 based on the distance c and the distance d. The distances c and d can be constant. They may also increase or decrease.

The apparatus according to the invention with a suction device (see FIGS. 8*a* to 8*c*, 9*a* to 9*c*, 10 and 12) and/or a blowing device (see FIGS. 10 to 12) may if desired include any of the constructions illustrated in FIGS. 4 to 7.

In respect of the mode of operation and operating sequence of an illustrative apparatus according to the invention:

Lap Preparation

A plurality of slivers are combined to form a lap 16 and drafted together. A plurality of laps 16 can be doubled by being placed one on top of the other. The resulting lap 16 is introduced directly into the feed element 10 of the rotor combing machine 2. The flow of material is not interrupted by forming a wound lap.

Feed

Unlike a flat combing machine, the upstream lap 16 is fed continuously by means of a conveyor element. The feed quantity is determined by the length of lap 16 conveyed between two closure time points of the nippers 18 (reversing nippers) of the first rotor 12 (turning rotor).

Clamping 1

The fibre tuft aligned and projecting out of the lap 16 is clamped by a clamping device 18 (reversing nipper) of the first rotor 12 (turning rotor). The clamping device 18 of the first rotor 12 assumes the function of detachment.

Delivery from the Supply Device onto, and Take Up by, the First Roller with Suction Device.

Figure 8A:
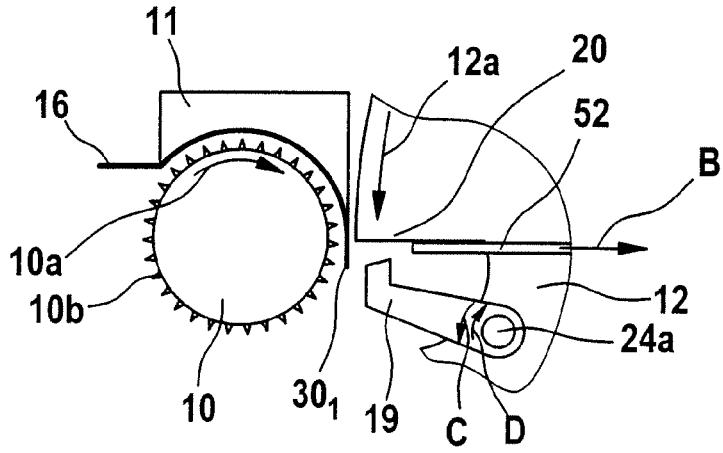
FIGS. 8*a* to 8*c* show in diagrammatic form the operating sequence during transfer of a supplied fibre sliver from the supply device onto, and take up by, the first roller with suction device.
Figure 8B:
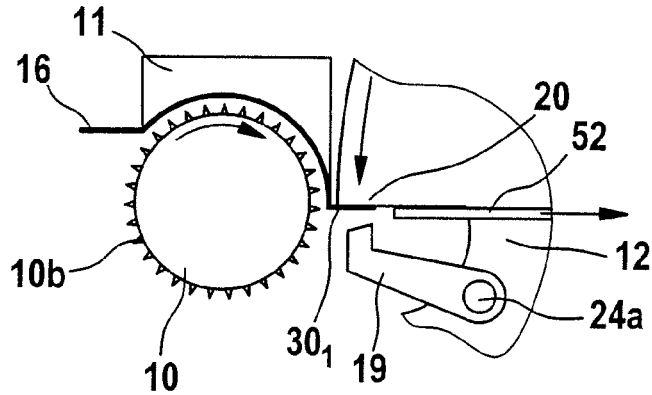
Figure 8C:
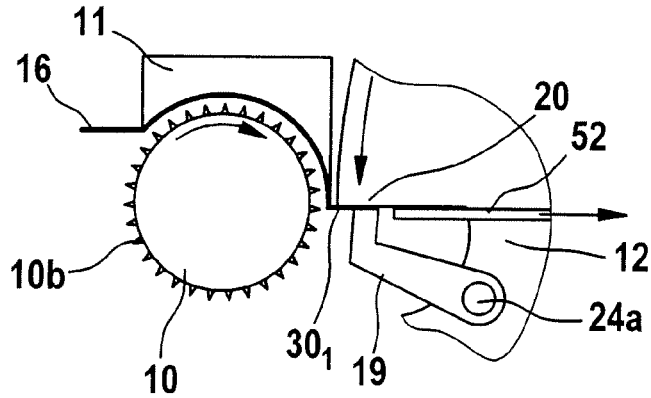

FIGS. 8*a* to 8*c* show in diagrammatic form the operating sequence during transfer of the supplied fibre material $\mathbf{30}_1$ from the feed roller 10 to the first roller 12 (turning rotor) acted upon by suction and the take-up of the supplied fibre material $\mathbf{30}_1$ from the feed roller 10 by the first roller 12 acted upon by suction, the Figures showing one after the other in chronological order: according to FIG. 8*a*, intake of the fibre material 16 by the feed roller 10 in direction 10*a* and advance of the free end $\mathbf{30}_1$ into the suction region of the roller 12 with clamping of the fibre material between the comb segments 10*b* and the nose of the feed tray 11. FIG. 8*b* shows suction of the free end $\mathbf{30}_1$ by the air current B of the suction channel 52 between the upper nipper 19 and the lower nipper 20. Through the suction, the fibre bundle $\mathbf{30}_1$ is bent at an angle and straightened. In this operation, the fibre sliver $\mathbf{30}_1$ continues to be clamped between feed roller 10 and feed tray 11. In accordance with FIG. 8*c*, a rotation of the upper nipper 19 around the pivot joint 24*a* in direction D is effected and thereby a closure of the clamping device 18, wherein an end region $\mathbf{30}_1$ of the fibre sliver is clamped between upper nipper 19 and lower nipper 20.

Removal

As a result of the rotation of the turning rotor 12 in direction 12*a* with the reversing nippers 18 located thereon, the clamped fibre bundle is removed from the feed lap, it being necessary for a retaining force to act on the lap 16 so that the fibres in the lap 16 not clamped by the reversing nipper 18 are retained. The retaining force is applied by the conveyor element of the feed means or by additional means such as a feed tray 11 or a top comb. The elements that generate the retaining force assume the function of the top comb.

Clamping 2

The fibre bundle is aligned and transferred to the clamping device 21 (combing nipper) of the second rotor 13 (combing rotor). The distance between the reversing nipper clamping line and the combing nipper clamping line at the time the combing device 21 closes determines the ecartement.

Figure 9A:
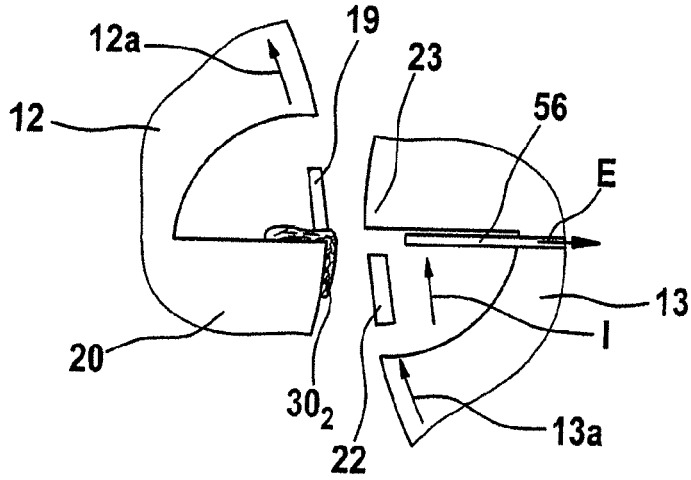
FIGS. 9*a* to 9*c* show in diagrammatic form the operating sequence during transfer of the fibre bundle transported in rotation from the first roller onto, and take up by, the second roller with suction device.
Figure 9B:
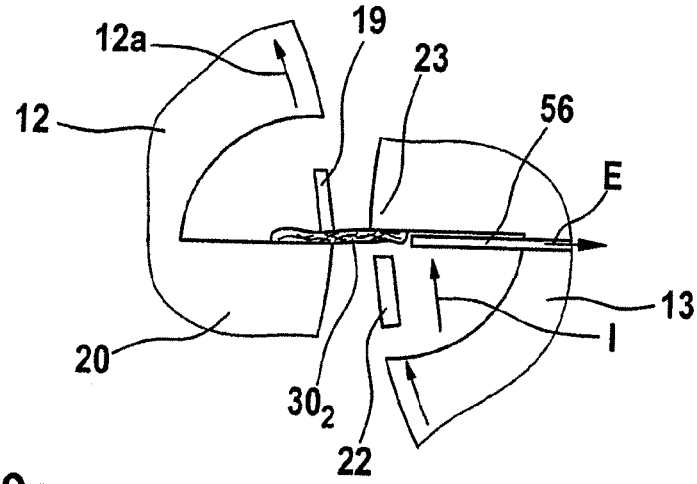
Figure 9C:
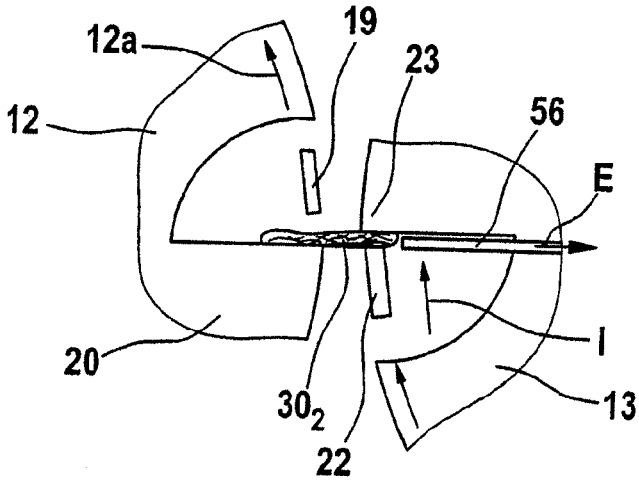

Delivery from the first roller onto, and take up by, the second roller with suction device FIGS. 9*a* to 9*c* show in diagrammatic form the operating sequence during transfer of the supplied fibre material $\mathbf{30}_2$ from the first roller 12 to the second roller 13 (turning rotor) acted upon by suction and the take-up of the supplied fibre material $\mathbf{30}_2$ from the first roller 12 by the second roller 13 acted upon by suction, the Figures showing one after the other in chronological order:

In FIG. 9*a*, transport of the fibre bundle $\mathbf{30}_2$ by the roller 12 in direction 12*a* into the suction region of the roller 13 with clamping of the clamped end of the fibre bundle $\mathbf{30}_2$ by the closed clamping device 18 comprising upper nipper 19 and lower nipper 20. According to FIG. 9*b*, suction of the free end of the fibre bundle $\mathbf{30}_2$ by the air current E of the suction channel 56 between the upper nipper 22 and the lower nipper 23. Through the suction, the fibre bundle $\mathbf{30}_2$ bent at an angle is stretched out and aligned. In this operation, the one end region of the fibre bundle $\mathbf{30}_2$ continues to be clamped between upper nipper 19 and lower nipper 20 of the closed clamping device 18. In accordance with FIG. 9*c*, a rotation of the upper nipper 22 around the pivot joint 24*b* in direction I is effected and thereby a closure of the clamping device 21, wherein the other end region of the fibre sliver $\mathbf{30}_2$ is clamped between upper nipper 22 and lower nipper 23.

Combing

The free end projecting out of the combing nipper 21 contains non-clamped fibres that are eliminated by means of combing.

Piecing

The combed-out fibre bundle is deposited on a take-off roller 14. The surface of the take-off roller 14, which surface is acted upon by suction and is air-permeable, causes the fibre bundle to be deposited, stretched-out, on the take-off roller 14. The fibre bundles are placed one on top of the other, overlapping in the manner of roof tiles, and form a web.

Web Removal and Combed Sliver Formation

The web 17 is removed from the take-off roller 14 at a point on the take-off roller not acted upon by suction and is guided into a funnel 34.

Comber Sliver Procedure

The resulting comber sliver can be doubled and drafted (drafting system 50) and is then deposited, for example, in a can 3*b* by means of coiler 3*a*.

Figure 10:
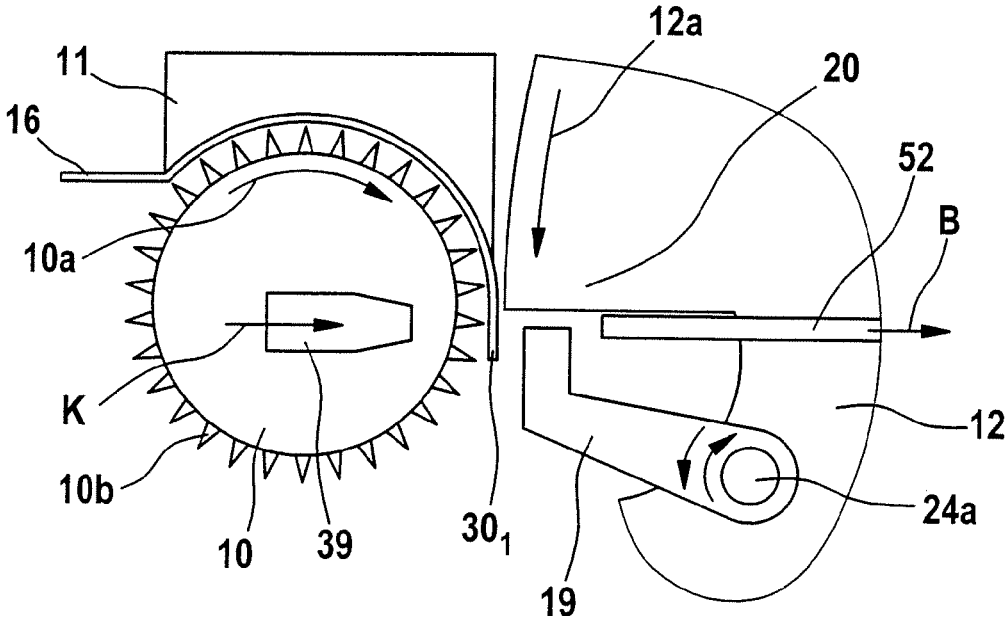
FIG. 10 shows a supply device as in FIGS. 8*a* to 8*c* with a suction device associated with the first roller and additionally with a blown air nozzle arranged inside the feed roller.

In the embodiment shown in FIG. 10, a supply device 8 as in FIGS. 8*a* to 8*c* is shown with a suction channel 52 associated with the first roller 12. In addition, inside the feed roller there is a blast air nozzle 39, which is connected to a source of blown air (not illustrated). The cylinder casing of the feed roller 10 has openings, which allow the passage of the blown air current K. The blown air current K is directed onto the fibre sliver end $\mathbf{30}_1$. The blown air current K is substantially in alignment with the suction air current B.

Figure 11:
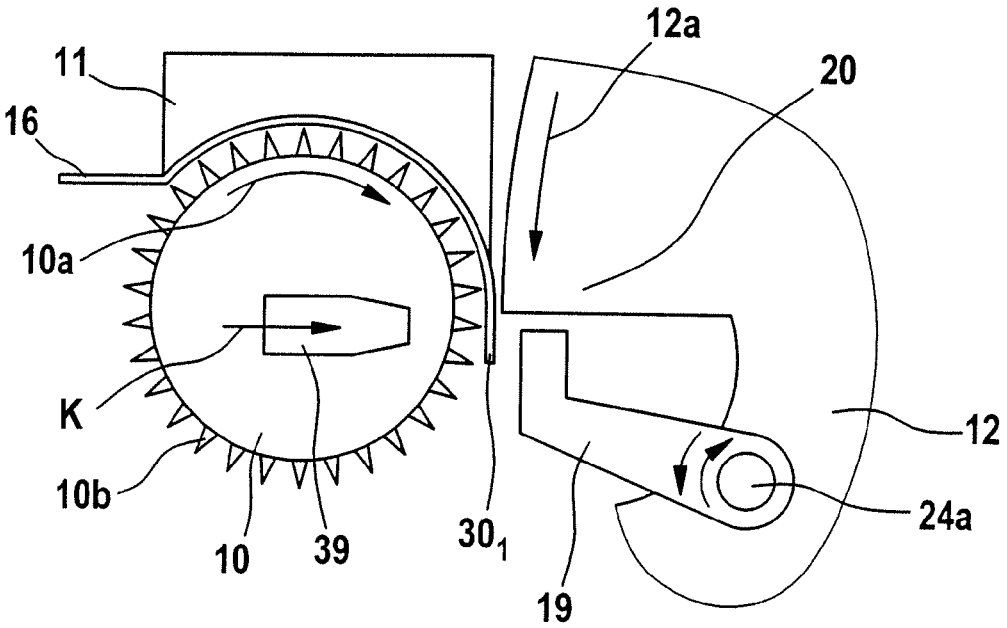
FIG. 11 shows a feed device with a blown air nozzle arranged inside the feed roller.

FIG. 11 shows an embodiment like FIG. 10, but in which only a blown air channel 39, i.e. no suction channel 52, is provided.

Figure 12:
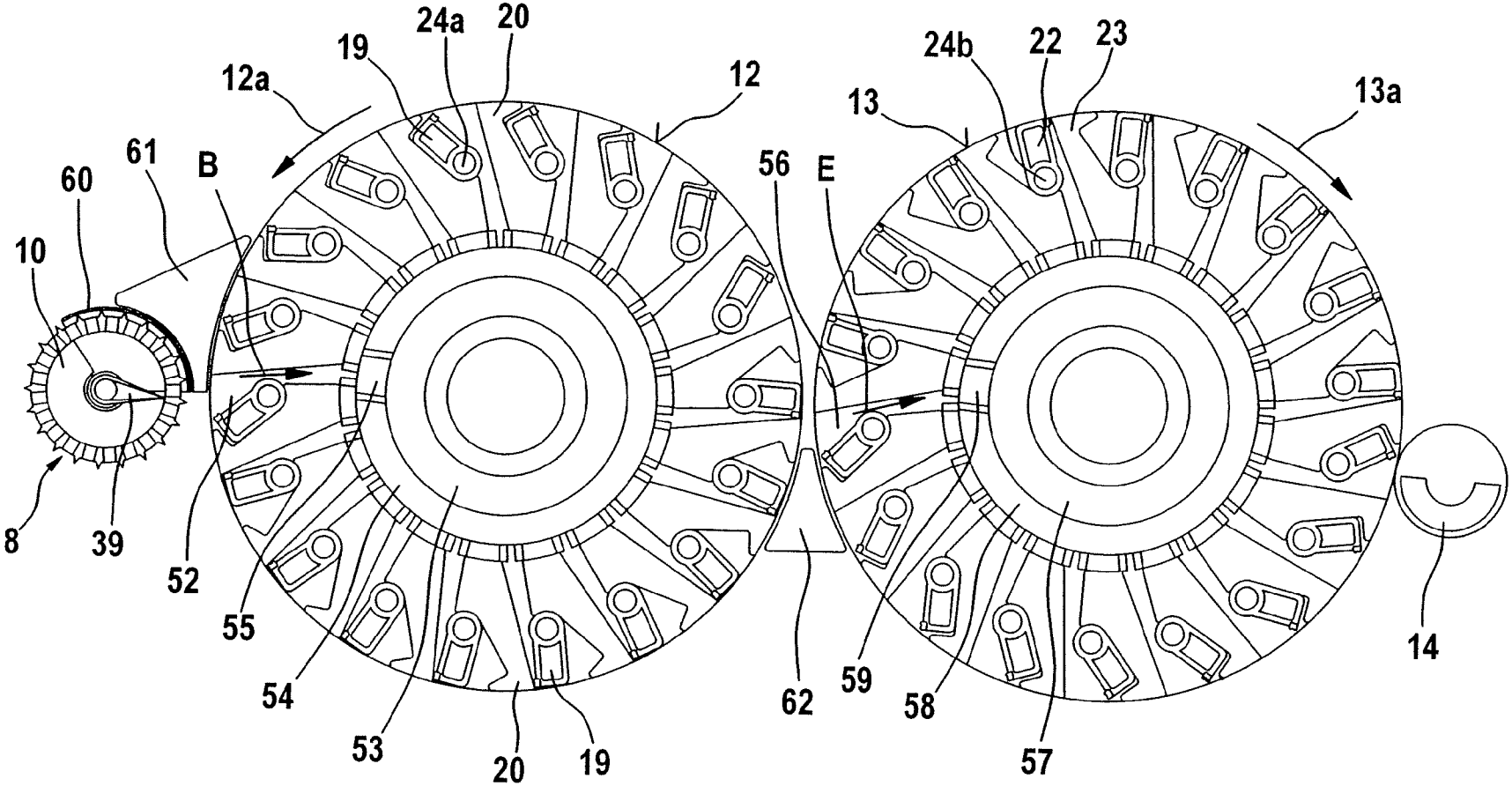
FIG. 12 shows a rotor combing machine as in FIG. 2 with reduced pressure channels and suction openings, associated in each case with the clamping devices of the first and second rollers, as well as a blown air nozzle inside the supply roller.

In the embodiment of FIG. 12, the rotatably mounted rollers 12 and 13 with clamping devices 19, 20 and 22, 23 respectively are additionally fitted with suction channels 52 and 56 respectively (suction openings) which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery to the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper). In the interior of the rotors 12, 13 there is a reduced pressure region 53 to 55 and 57 to 59, respectively, created by the suction flow at the suction openings 52, 56. The reduced pressure can be generated by connecting to a flow-generating machine. The suction flow at the individual suction openings 52, 56 can be so switched between reduced pressure region and suction opening that it is applied only at particular selected angular positions on the roller circumference. For the purpose of the switching, valves or a valve pipe 54, 58 with openings 55 and 59, respectively, in the corresponding angular positions can be used. The release of the suction flow may also be brought about by the movement of the gripping element (upper nipper). Furthermore, it is possible to arrange a region of reduced pressure only at the corresponding angular positions.

Additionally, a flow of blown air can be provided in the region of the supply device 8 and/or in the region of transfer between the rollers. The source of the flow of blown air (blowing nozzle 39) is arranged inside the feed roller 10 and has effect, through the air-permeable surface of the supply device or air passage openings, towards the outside in the direction of the first roller. Also, in the region of the supply device 8, the element for producing the blown air current can be fixedly arranged, directly under or over the supply device 8. In the region of the transfer between the rollers 12, 13 the blown air current sources can be arranged at the rotor perimeter of the first roller 12, directly under or over each nipper device. For the blown air generation there may be used compressed air nozzles or air blades.

The suction flow B can favourably influence and shorten not only the guiding, but also the separation process between the lap and the bundles to be removed in the region of the supply device 8.

As a result of the provision of additional air guide elements 60 and lateral screens 61, 62 the direction of the flow can be influenced and the air carried round with the rotors separated off. In that way, the time for alignment can be further shortened. In particular, a screen element between the first rotor 12 and supply device 8 over the lap and a screen element on each side of the roller have proved useful.

The combed-out fibre portion passes from the second roller 13 onto the piecing roller 14.

Figure 13:
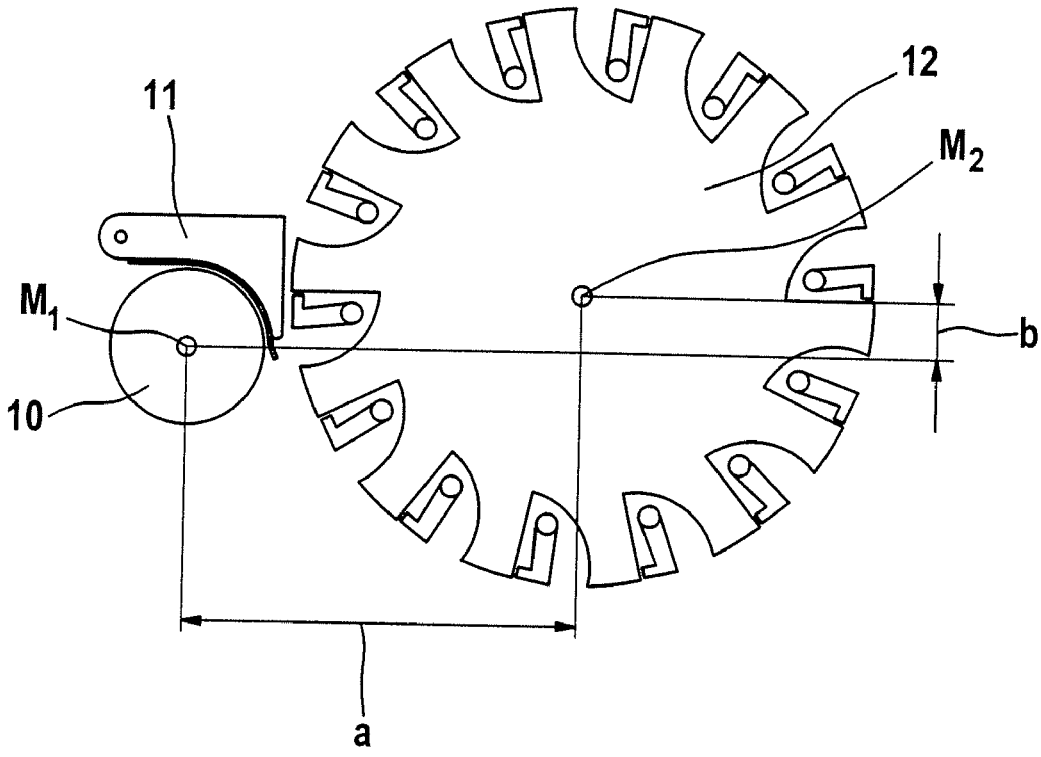
FIG. 13 shows the adjustable distances a and b between feed unit and turning rotor.

In the embodiment shown in FIG. 13, the distance between the centre point $M_1$ of the feed roller 10 and the centre point $M_2$ of the turning rotor 12 in the horizontal direction is denoted by reference letter "a" and in the vertical direction by the reference letter "b". The distances a and b are adjustable by devices (not shown), e.g. having a powered drive. The feed roller 10 may, together with the feed tray 11, that is to say the feed unit 8 as whole, be displaced locally. The distance a and/or the distance b to the turning rotor 12 is thereby adjustable. The position of the centre points $M_1$ and $M_2$ of the feed roller 10 and the turning rotor 12 respectively with respect to one another is also adjustable.

Figure 14A:
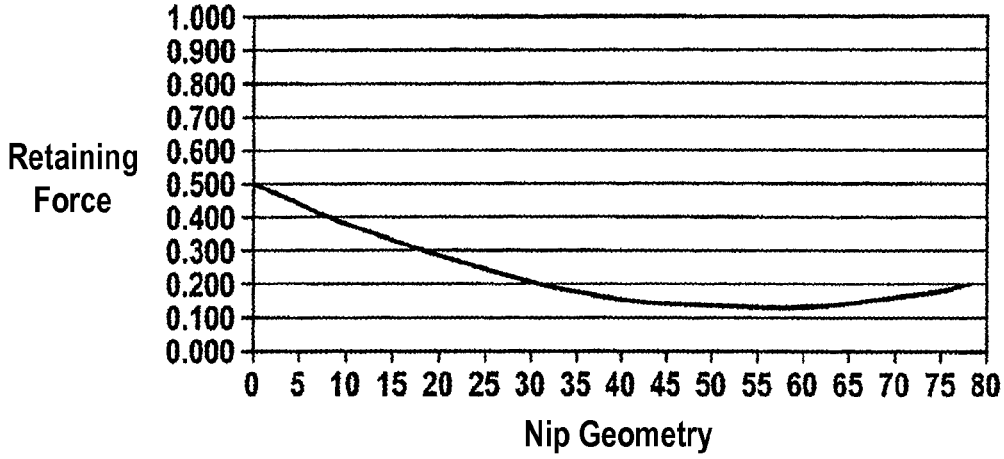
FIGS. 14*a*, 14*b* show two nip geometries when using a top feed tray with altered feed tray settings.
Figure 14B:
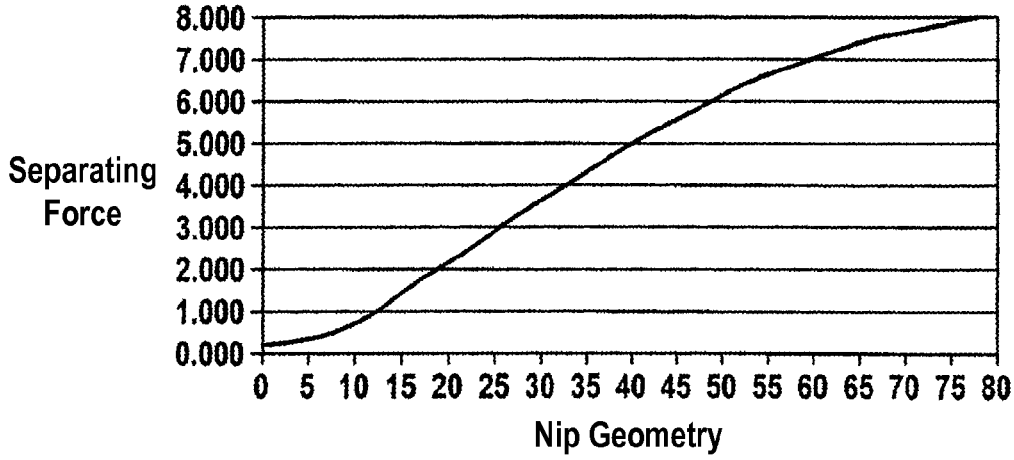

Different nip geometries (nip 27) can be achieved even with constant tray geometry by means of a variable tray setting. FIGS. 14*a* and 14*b* illustrate different nip geometries when using a tray. A nip geometry adapted to the material enables optimum values to be achieved in respect of retaining force set and separation force required to release the feed bundle $\mathbf{30}_1$ from the material feed 16.

Figure 15:
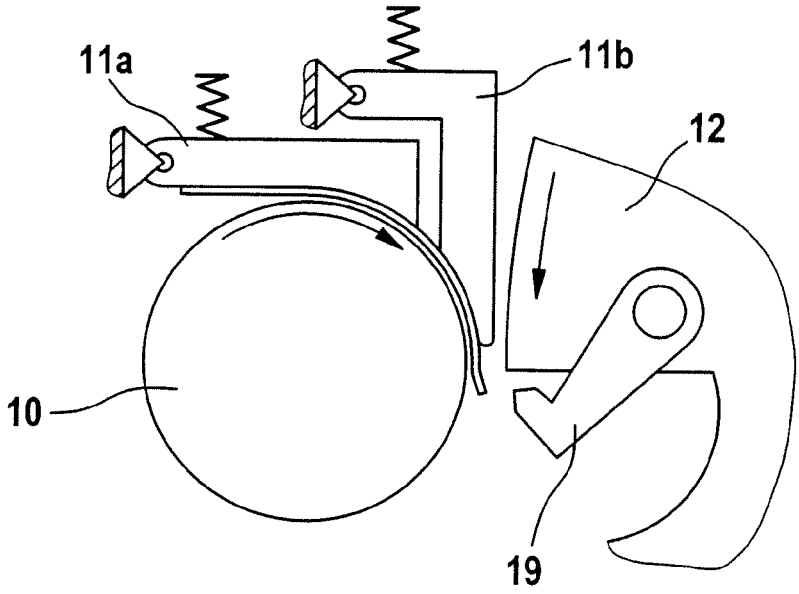
FIG. 15 shows a construction of the feed tray as a divided tray.

According to FIG. 15, the feed tray 11 is in the form of a divided tray. The configuration of the tray in several segments (at least two segments 11*a*, 11*b*) permits a more flexible adjustment, for example, the application of different clamping forces at the individual segments to achieve the optimum in respect of set retaining force and required separation force.

Figure 16:
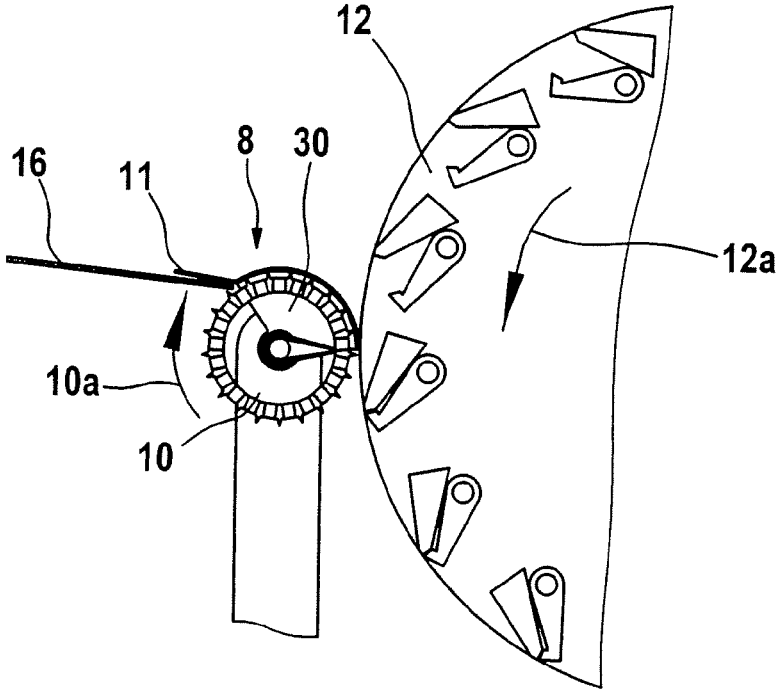
FIG. 16 shows the jetting from the feed roller.

Optimised feed tuft deflection and feed bundle separation is effected corresponding to FIG. 16 by jetting from the feed roller 10. The jetting pressure and the jetting angle are adjustable here.

Figure 17:
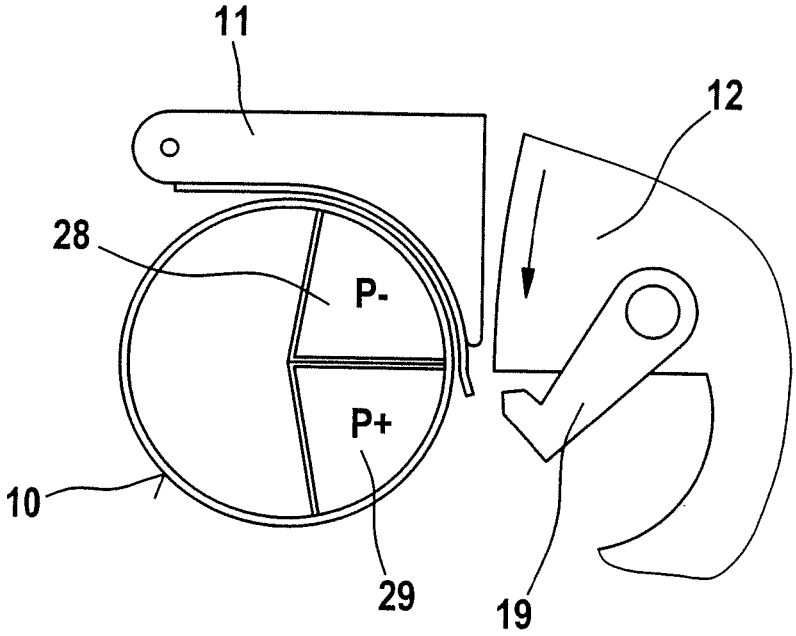
FIG. 17 shows a reduced pressure region in the feed roller to assist or generate the retaining force, and an increased pressure region for deflecting and separating the feed bundle.

To assist the retaining force in the tray region or to generate the retaining force, the feed roller 10 is provided with a reduced pressure region (FIG. 17). The reduced pressure is adjustable. Suction can be effected continuously or in timed mode. Reference numeral 28 denotes a reduced pressure P− region and 29 an increased pressure P+ region. The reduced pressure region 28 in the feed roller 10 serves to assist and generate the retaining force and the increased pressure region 29 to deflect and separate the feed tuft $\mathbf{30}_1$.

In the case of jetting from the feed roller or when a reduced pressure region in the feed roller is implemented, a perforated feed roller 10 is used. If clothed rollers are used, then in order to be air-permeable use is made of, for example, clothings having a profiled clothing foot. A portion of the inner cylindrical surface of the feed roller 10 may be sealed by screen elements 30 (see FIG. 16). The distance of the screen elements from the feed roller 10 in the radial direction should be as small as possible. Distances of 0 mm are also possible, e.g. when using slide seal rings.

Laps or slivers are fed to the feed unit 8. The infeed weight normally amounts to 60 to 80 ktex, or alternatively higher infeed masses or lower infeed masses are used, depending on the desired product quality and production output. With lap infeed, an automatic lap change with an automated piecing process can be implemented. Lap transport from the lap-forming machine to the rotor combing machine can be effected by means of conveyor systems. The material infeed is effected continuously or the feed can be implemented according to predetermined equations of motion, e.g. an initially rapid feed, which becomes slower towards the end of the feed, or a feed in the form of a pilgrim-step motion. This provides advantages in respect of tuft delivery to the turning rotor 12. Elements for the sliver or lap infeed can be, for example, a driven supply table 31 in the case of sliver feed or drive rollers and guide plates in the case of lap infeed.

Figure 18:
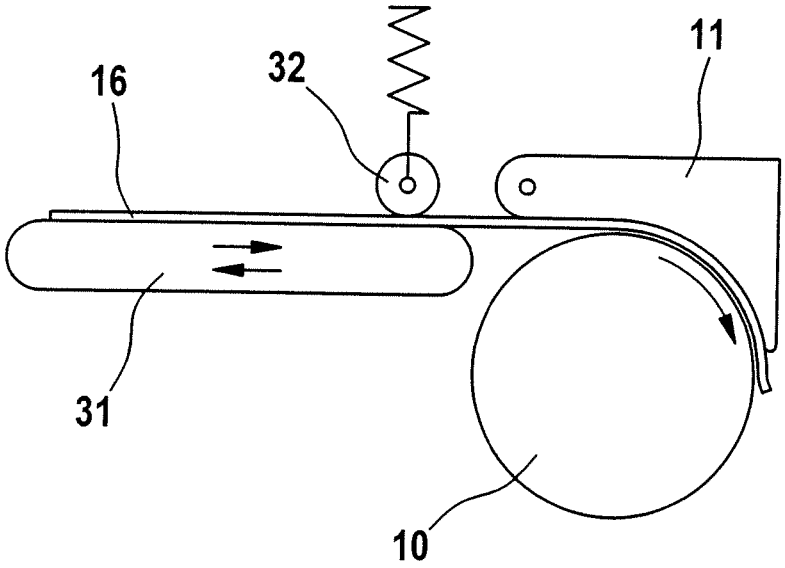
FIG. 18 shows pre-compression of the input material (pressure-applying roller) upstream of the tray inlet.

Immediately upstream of the inlet to the feed tray 11 a pre-compression of the incoming fibre material 16 is provided, for example, by a loaded roller 32 (FIG. 18), leaf springs or funnels.

Additional elements, for example, for the accelerated feed bundle deflection and separation, can be located in the turning rotor 32. This involves, for example, a region with air passage openings, which is connected to a source of reduced pressure. The reduced pressure is adjustable. Suction can be effected continuously or in timed mode. The region with the air passage openings can lie inside the periphery of the turning rotor 12, so that the peripheral cylindrical surface of the rotor 12 does not counteract the deflection of the fibre tuft. An optimised feed tuft deflection and separation can be effected by an externally mounted nozzle assembly. The jetting pressure and the jetting angle and the position of the nozzles are adjustable here.

Figure 19:
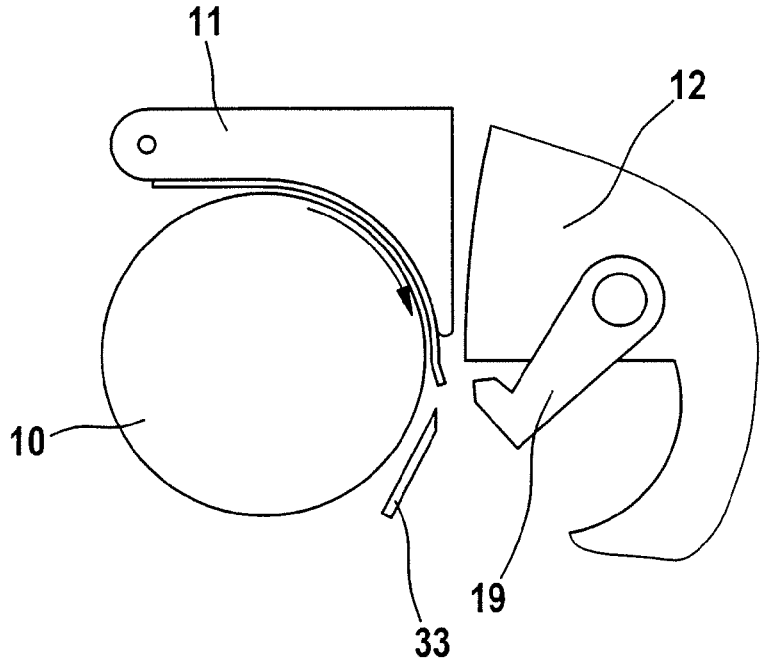
FIG. 19 shows a top comb between feed device and turning rotor.

In the embodiment of FIG. 19, a top comb 33 is arranged between the feed roller 10 of the feed device 8 and the turning rotor 12.

Figure 20:
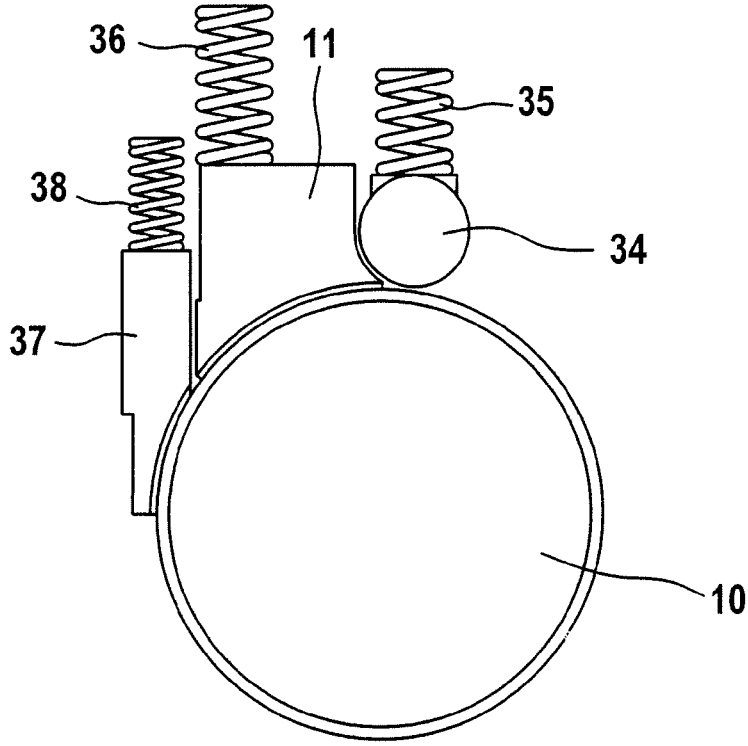
FIG. 20 shows the pre-compression of the input material upstream of the feed tray inlet. Illustration: recessed tray, positive drive on feed roller, spring-loaded roller.

Using the device according to the embodiment shown in FIG. 20, a pre-compression of the incoming material 16 is implemented upstream of the tray inlet. For that purpose, a recessed tray 11, a positive drive on feed roller 10 and a spring-loaded roller 34 are provided. The pre-compression of the incoming material 16 is effected with a roller. The drive of the roller 34 can be effected by means of a positive drive on the feed roller 10. The roller 34 may also have its own drive. The clamping region of the roller, for example, clamping line, is situated as close as possible to the tray inlet owing to a recess in the tray. The surface of the roller 34 may be rubberised. Alternatively, a solid roller, a milled roller or a clothed roller may be used. The load force of the roller is adjustable. The roller is loaded, for example, by a spring 35. The tray 11 is loaded by a spring 36. A further tray-form element 37, which is associated with the feed roller 10, is loaded by a spring 38.

In use of the rotor combing machine according to the invention there is achieved a mechanical combing of the fibre material to be combed out, that is, mechanical means are used for the combing. There is no pneumatic combing of the fibre material to be combed, that is, no air currents, e.g. suction and/or blown air currents, are used for combing.

In the rotor combing machine according to the invention there are present rollers that rotate rapidly without interruption and that have clamping devices. Rollers that rotate with interruptions, stepwise or alternating between a stationary and rotating state are not used.

Although the foregoing invention has been described in detail by way of illustration and example for purposes of understanding, it will be obvious that changes and modifications may be practiced within the scope of the appended claims.

The invention claimed is:

1. An apparatus for the fibre-sorting or fibre-selection of a fibre bundle comprising textile fibres, the apparatus comprising:

a fibre sorting device comprising at least a first roller and a second roller that rotate rapidly without interruption during use;

clamping devices distributed about the periphery of at least one of said first and second rollers, each clamping device adapted to clamp a bundle of the textile fibres at a clamping site located at a distance from a free end of the bundle;

a supply device adapted to supply the fibre bundle to the fibre-sorting device, the supply device comprising a feed unit including a feed roller and at least one feed tray, the feed roller and at least one feed tray defining a nip therebetween, wherein the nip is adapted to generate a retaining force sufficient to completely or substantially completely retain short fibres in the fibre bundle during separation of the fibre bundle by the clamping devices; and at least one mechanical combing device that generates a combing action from the clamping site to the free end of the fibre bundle in order to loosen and remove non-clamped constituents;

wherein the distance of the feed unit from the first roller is adjustable.

2. An apparatus according to claim 1, wherein the at least one feed tray comprises a top feed tray or a bottom feed tray.

3. An apparatus for the fibre-sorting or fibre-selection of a fibre bundle comprising textile fibres, the apparatus comprising:

a fibre sorting device comprising at least a first roller and a second roller that rotate rapidly without interruption during use;

clamping devices distributed about the periphery of at least one of said first and second rollers, each clamping device adapted to clamp a bundle of the textile fibres at a clamping site located at a distance from a free end of the bundle;

a supply device adapted to supply the fibre bundle to the fibre-sorting device, the supply device comprising a feed unit including a feed roller and at least one feed tray, the feed roller and at least one feed tray defining a nip therebetween, wherein the nip is adapted to generate a retaining force sufficient to completely or substantially completely retain short fibres in the fibre bundle during separation of the fibre bundle by the clamping devices; and at least one mechanical combing device that generates a combing action from the clamping site to the free end of the fibre bundle in order to loosen and remove non-clamped constituents;

wherein the relative positions of the centre points of the feed roller and the first roller are adjustable.

4. An apparatus according to claim 1, wherein the feed tray defines a clamping line or clamping region having a position that is adjustable relative to the periphery of the feed roller.

5. An apparatus according to claim 4, wherein a feed amount is flexibly and infinitely adjustable.

6. An apparatus according to claim 1, wherein the feed tray has a variable position with respect to the feed roller, thereby defining differing nip geometries between the feed tray and the feed roller.

7. An apparatus according to claim 1, wherein the feed tray has a length and a contour that are alterable.

8. An apparatus according to claim 1, wherein the nip geometry is adjustable to set the retaining force set and the separation required to achieve an optimum release of the fibre bundle from feed material.

9. An apparatus according to claim 1, wherein the feed tray is loadable with variable forces.

10. An apparatus according to claim 1, wherein the feed tray comprises a divided tray.

11. An apparatus according to claim 10, wherein the feed tray is divided into a plurality of segments along a flow direction of the fibre material.

12. An apparatus for the fibre-sorting or fibre-selection of a fibre bundle comprising textile fibres, the apparatus comprising:

a fibre sorting device comprising at least a first roller and a second roller that rotate rapidly without interruption during use;

clamping devices distributed about the periphery of at least one of said first and second rollers, each clamping device adapted to clamp a bundle of the textile fibres at a clamping site located at a distance from a free end of the bundle;

a supply device adapted to supply the fibre bundle to the fibre-sorting device, the supply device comprising a feed unit including a feed roller and at least one feed tray, the feed roller and at least one feed tray defining a nip therebetween, wherein the nip is adapted to generate a retaining force sufficient to completely or substantially completely retain short fibres in the fibre bundle during separation of the fibre bundle by the clamping devices;

at least one mechanical combing device that generates a combing action from the clamping site to the free end of the fibre bundle in order to loosen and remove non-clamped constituents; and a device for generating a jet of blown air adapted to optimize feed bundle deflection and feed bundle separation.

13. An apparatus according to claim 12, wherein the blown air device comprises passages for the jet of blown air located within the feed roller.

14. An apparatus for the fibre-sorting or fibre-selection of a fibre bundle comprising textile fibres, the apparatus comprising:

a fibre sorting device comprising at least a first roller and a second roller that rotate rapidly without interruption during use;

clamping devices distributed about the periphery of at least one of said first and second rollers, each clamping device adapted to clamp a bundle of the textile fibres at a clamping site located at a distance from a free end of the bundle;

a supply device adapted to supply the fibre bundle to the fibre-sorting device, the supply device comprising a feed unit including a feed roller and at least one feed tray, the feed roller and at least one feed tray defining a nip therebetween, wherein the nip is adapted to generate a retaining force sufficient to completely or substantially completely retain short fibres in the fibre bundle during separation of the fibre bundle by the clamping devices;

at least one mechanical combing device that generates a combing action from the clamping site to the free end of the fibre bundle in order to loosen and remove non-clamped constituents;

wherein the feed roller has a reduced pressure region adapted to generate a retaining force in the region of the feed tray.

15. An apparatus according to claim 14, wherein the feed roller has a perforated surface.

16. An apparatus according to claim 15, wherein the feed roller has an inner cylindrical surface, and a portion of the inner cylindrical surface is sealed by screen elements.

17. An apparatus according to claim 1, wherein an infeed weight of the textile fibres amounts to about 60 to 80 ktex.

18. An apparatus according to claim 1, wherein the feed unit further comprises a pressure-applying element adapted to generate pre-compression of the incoming fibre material.

19. An apparatus for the fibre-sorting or fibre-selection of a fibre bundle comprising textile fibres, the apparatus comprising:

a fibre sorting device comprising at least a first roller and a second roller that rotate rapidly without interruption during use;

clamping devices distributed about the periphery of at least one of said first and second rollers, each clamping device adapted to clamp a bundle of the textile fibres at a clamping site located at a distance from a free end of the bundle;

a supply device adapted to supply the fibre bundle to the fibre-sorting device, the supply device comprising a feed unit including a feed roller and at least one feed tray, the feed roller and at least one feed tray defining a nip therebetween, wherein the nip is adapted to generate a retaining force sufficient to completely or substantially completely retain short fibres in the fibre bundle during separation of the fibre bundle by the clamping devices; and at least one mechanical combing device that generates a combing action from the clamping site to the free end of the fibre bundle in order to loosen and remove non-clamped constituents;

wherein the first roller comprises a region with air passage openings connected to a source of reduced pressure for accelerated feed bundle deflection and separation.

20. An apparatus according to claim 12, wherein the device for generating the blown air jet comprises an externally mounted nozzle assembly.

21. An apparatus according to claim 1, wherein the feed tray includes a measuring device that measures lap thickness and/or a determining device that determines the feed tray clamping force, wherein the measuring device and/or determining device are integrated in the feed tray.

22. An apparatus according to claim 1, further comprising a top comb arranged between the feed device and said first roller.

23. An apparatus according to claim 1, wherein said first roller and said second roller comprise a turning rotor and a combing rotor.

24. An apparatus according to claim 23, wherein the turning rotor and the combing rotor have opposite directions of rotation.

* * * * *